US009828171B2

(12) United States Patent
Blanchette et al.

(10) Patent No.: US 9,828,171 B2
(45) Date of Patent: Nov. 28, 2017

(54) SHOCK ABSORBER FOR CONTAINER FOR FRANGIBLE ITEMS

(71) Applicant: PACTIV CANADA INC., Scarborough (CA)

(72) Inventors: François Blanchette, Mirabel (CA); François St-Louis, Sainte-Julie (CA); Germain Archambault, Saint-Hubert (CA)

(73) Assignee: PACTIV CANADA INC., Scarborough, Ontario ( * ) Notice: Subject to any disclaimer, the term of this patent is extended or adjusted under 35 U.S.C. 154(b) by 61 days.

(21) Appl. No.: 13/677,830

(22) Filed: Nov. 15, 2012

(65) Prior Publication Data

US 2014/0131245 A1 May 15, 2014

(51) Int. Cl.
*B65D 85/32* (2006.01)

(52) U.S. Cl.
CPC ..... *B65D 85/32* (2013.01)

(58) Field of Classification Search
CPC .... B65D 85/321; B65D 85/32; B65D 85/322; B65D 85/324; B65D 85/325; B65D 85/327; B65D 85/328; B65B 23/02; Y10S 493/913
USPC ..... 206/521.1, 521.8, 521.7, 521.6, 521
See application file for complete search history.

(56) References Cited

U.S. PATENT DOCUMENTS 2,600,130 A * 6/1952 Schilling ..... 206/521.8
2,918,204 A * 12/1959 Butterfield ..... 229/406
3,123,519 A * 3/1964 Reifers et al. ..... 162/223
3,421,682 A * 1/1969 Eisenbach ..... 206/502
3,603,499 A * 9/1971 Snow et al. ..... 206/521.8
3,613,987 A * 10/1971 Laidman ..... 206/521.1
3,779,370 A * 12/1973 Snow et al. ..... 206/521.8
3,790,062 A * 2/1974 Boyd ..... 206/521.1
3,813,027 A * 5/1974 Misdom et al. ..... 206/521.1
4,088,259 A * 5/1978 Sutton ..... 206/521.1
4,194,682 A * 3/1980 Congleton et al. ..... 206/521.1
4,394,214 A * 7/1983 Bixler et al. ..... 162/228
4,448,344 A * 5/1984 Lord et al. ..... 206/521.1
4,553,692 A * 11/1985 Padovani ..... 206/521.1
4,795,080 A * 1/1989 McIntyre ..... 206/521.1
5,950,830 A * 9/1999 Trigger ..... 206/440
6,012,583 A * 1/2000 Ramirez ..... 206/521.1
7,255,231 B2 * 8/2007 Andrews et al. ..... 206/521.1
2011/0120898 A1 * 5/2011 Archambault et al. .... 206/521.1
2011/0226656 A1 * 9/2011 Archambault et al. .... 206/521.1
2013/0183412 A1 * 7/2013 Ramirez ..... B65D 85/324 426/119
2013/0212981 A1 * 8/2013 Chait et al. ..... 53/443

* cited by examiner

*Primary Examiner* — Steven A. Reynolds
(74) *Attorney, Agent, or Firm* — Baker Botts L.L.P.

(57) ABSTRACT

Container includes a base portion having a plurality of item receiving cavities for supporting frangible items, at least one cover portion having at least one item covering concavity for covering the frangible items, a first hinge between a first longitudinal edge of the base portion and the cover portion for rotating the cover portion onto the base portion to hold the frangible items captive in the item receiving cavities, and a hollow ring projecting upwardly from a bottom surface of at least one of the item receiving cavities to define an annular contact surface for an item received in the item receiving cavity.

20 Claims, 3 Drawing Sheets

SHOCK ABSORBER FOR CONTAINER FOR FRANGIBLE ITEMS

FIELD OF THE APPLICATION

The present application relates to containers for receiving frangible objects such as eggs, and to structural components of such containers.

BACKGROUND OF THE ART

Egg containers of various kinds have been developed for the transportation and sale of eggs. As eggs are relatively fragile, the egg containers must protect the eggs from the various manipulations involved from the packaging of the eggs to the consumer's refrigerator. One significant improvement in egg containers is the use of thermoformed plastics as material for the egg containers. Thermoformed plastics are typically transparent, which allows the eggs to be visible, and are relatively inexpensive to produce. Hence, the consumer may inspect the eggs without having to open the container.

The packaging process in which eggs are inserted in egg containers is often automated. In such processes, and in manual packaging processes, eggs are dropped into their receiving cavities. For this reason, the bottom of egg containers are domed, so as to absorb the shock of a dropped egg. However, the domed bottom may cause a bounce of the egg, which may in turn result in eggs of adjacent egg receiving cavities contacting one another during packaging, when bouncing up.

SUMMARY OF THE APPLICATION

It is therefore an aim of the present disclosure to provide a container for frangible items such as eggs that addresses issues associates with the prior art.

Therefore, in accordance with the present application, there is provided a container for receiving frangible items comprising: a sheet of polymer formed into: a base portion having a plurality of item receiving cavities for supporting frangible items; at least one cover portion having at least one item covering concavity for covering the frangible items; a first hinge between a first longitudinal edge of the base portion and the cover portion for rotating the cover portion onto the base portion to hold the frangible items captive in the item receiving cavities; and a hollow ring projecting upwardly from a bottom surface of at least one of the item receiving cavities to define an annular contact surface for an item received in the item receiving cavity.

Further in accordance with the present application, there is provided a container for receiving frangible items comprising: a sheet of polymer formed into: a base portion having a plurality of item receiving cavities for supporting frangible items, with at least a pair of adjacent ones of the item receiving cavities being separated by a horizontal shoulder; at least one cover portion having at least one item covering concavity for covering the frangible items; a first hinge between a first longitudinal edge of the base portion and the cover portion for rotating the cover portion onto the base portion to hold the frangible items captive in the item receiving cavities; and at least one hollow separator wall projecting upwardly from at least one of the horizontal shoulder separating adjacent ones of the item receiving cavities.

DESCRIPTION OF THE PREFERRED EMBODIMENTS

Figure 1:
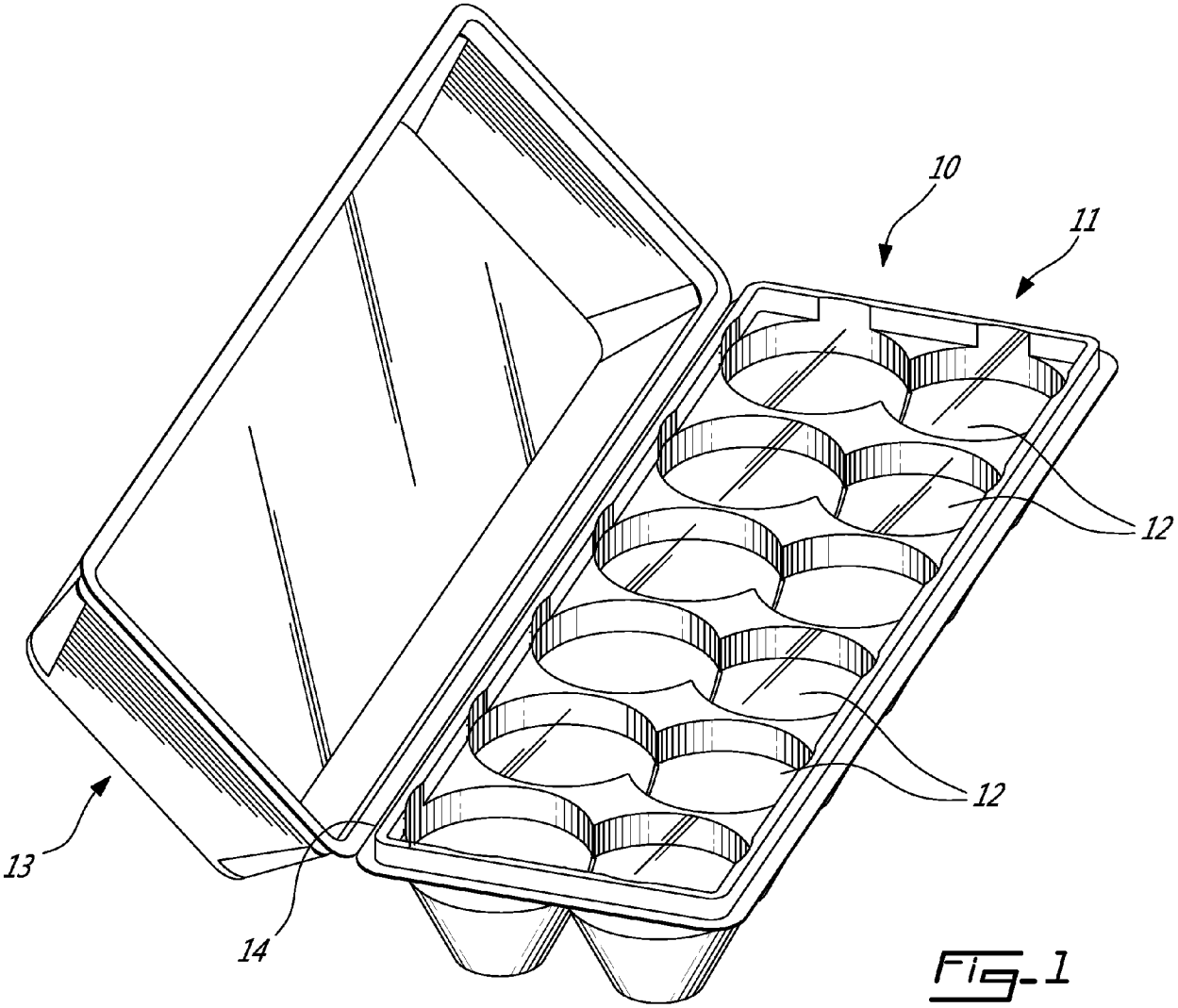
FIG. 1 is a schematic perspective view of a two-fold egg container.

Referring to the drawings and more particularly to FIG. 1, an egg container is generally shown at 10. The egg containers described hereinafter are preferably made of transparent or translucent plastics, for instance using a thermoforming process or other molding process. Other materials and/or processes may be used as well. The containers described hereinafter may be used to contain eggs or any other frangible items (e.g., tomatoes).

The egg container 10 of FIG. 1 is a two-fold egg container, as it has two portions hinged to one another. The egg container 10 has a base portion 11 having a plurality of receiving cavities 12 (e.g., six, twelve, eighteen, twenty-four, or any other suitable number), with each cavity 12 receiving an egg. A top cover portion 13 is hinged to the base portion 11 by hinge 14. The top cover portion 13 may or may not have individual cavities to cover a top portion of the eggs supported by the receiving cavities 12. Alternatively, the top cover portion 13 may present a flat top surface as in FIG. 1, with or without strengthening components (e.g., arches, posts). Although not shown, mating connectors or any other suitable type of connectors are provided on the periphery of the base portion 11 and top cover portion 13 for interlocking them when the egg container 10 is closed.

Figure 2:
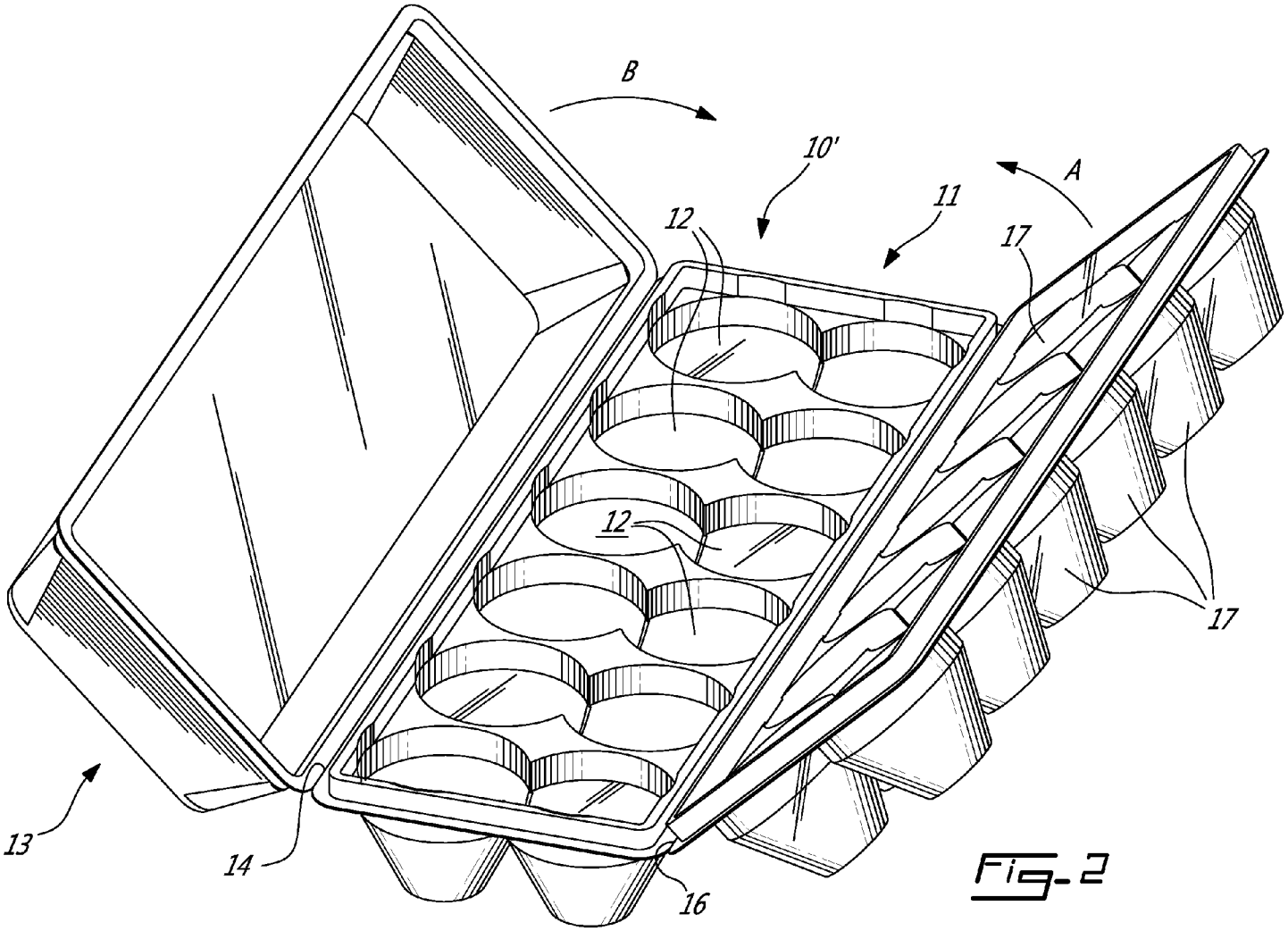
FIG. 2 is a schematic perspective view of a three-fold egg container.

Referring to FIG. 2, a three-fold egg container is generally illustrated at 10'. The egg container 10' is similar to the egg container 10 of FIG. 1, but has a middle cover portion 15. The middle cover portion 15 is hinged to the base portion 11 by hinge 16. The hinges 14 and 16 are preferably on opposite edges of the base portion 11. The middle cover portion 15 typically has egg cavities 17 to cover a top portion of the eggs supported by the egg-receiving cavities 12. Although not shown, mating connectors or any other suitable type of connectors are provided on the periphery of the top cover portion 13 and the middle cover portion 15 for interlocking them when the egg container 10' is closed.

In order to close the egg container 10', the middle cover portion 15 is firstly hinged into contact with the base container 12, as illustrated by arrow A. The top cover portion 13 is then hinged onto the middle cover portion 15, as illustrated by arrow B. When the egg container 10/10' is closed, peripheral flanges 21 and 22 lay flat one on the other.

Figure 3:
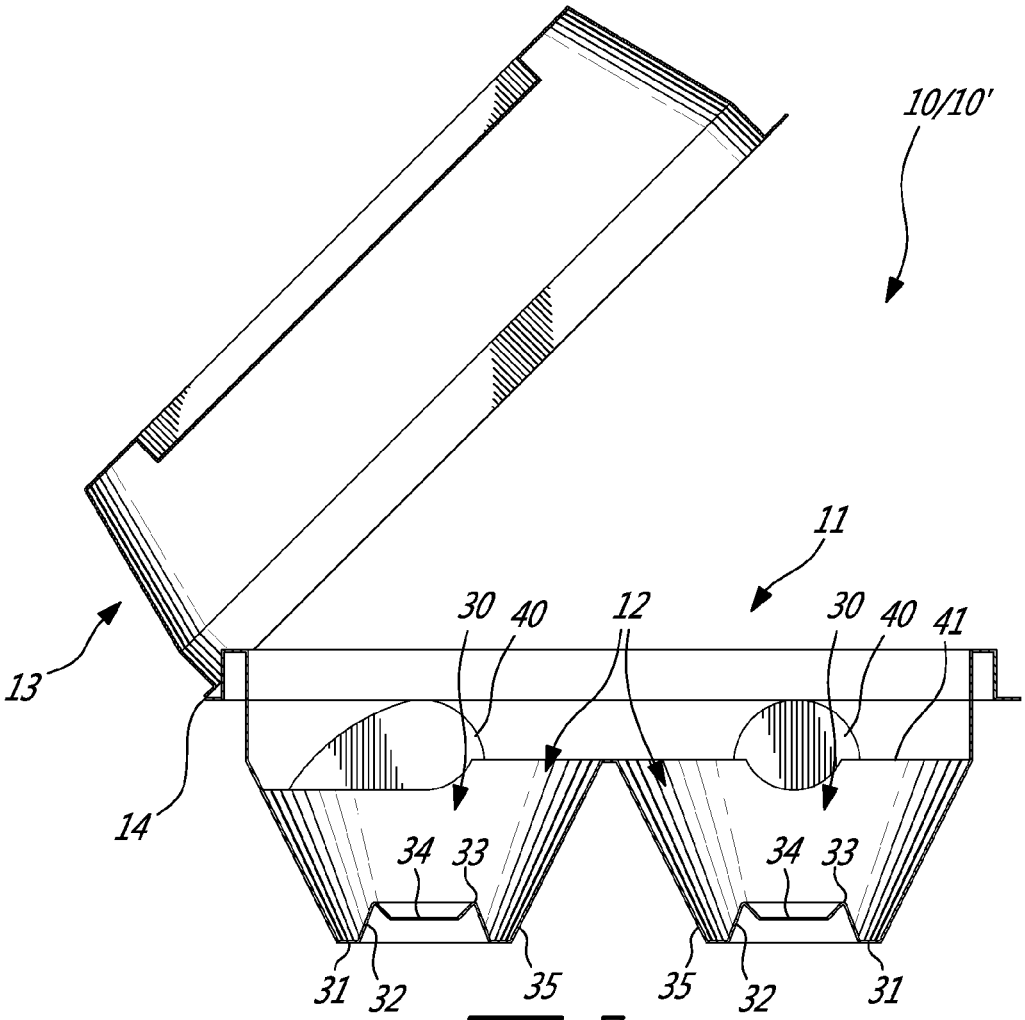
FIG. 3 is a sectional view of a receiving cavity of the egg container of FIGS. 1 and 2.

Referring to FIG. 3, there is illustrated in greater detail one of the receiving cavities 12. The receiving cavity is shown having an inverted frusto-conical shape. However, it is considered to use any other appropriate shapes, such as downwardly tapering cup shapes, frusto-egg shapes, cylinders, etc. In some instances, ribs, lugs, beams may be required to define a contact surface of the egg received in the receiving cavities 12.

A shock absorber 30 is provided in a bottom of the cavity 12. The shock absorber 30 may project upwardly from a wall 31 of the cavity 12 having generally planar surfaces. When the containers 10 and 10' are laid on the ground, the wall 31 typically lies on the ground. The shock absorber 30 is integral with the material of the cavity 12, as the egg containers 10 and 10' are made of a thermoformed sheet.

Figure 4:
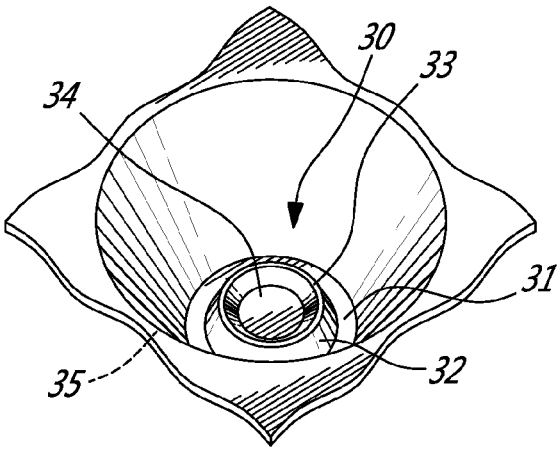
FIG. 4 is a perspective view of the receiving cavity of FIG. 3.

In FIGS. 3 and 4, the shock absorber 30 has a base 32 of frusto-conical shape, in an upright orientation. In an embodiment, the diameter at bottom of the base 32 is about 0.67"±0.08", and the frusto-conical shape is that of a cone having a height of 0.72"±0.09". However, other shapes are considered, such as a cylindrically-shaped base, for instance with a diameter of 0.56"±0.07". It is pointed out that the frusto-conical shape for the base 32 (with the flared receiving cavity 12) is well suited for the removal of the egg containers 10 and 10' from a mold.

A ring 33 projects upwardly from a top surface 34 of the base 32. In another embodiment, the ring 33 may project directly from a bottom of the receiving cavity 12 (e.g., from the wall 31). The ring 33 is hollow in that it defines a hollow volume between its inner and outer diameters, as it is the result of the thermoforming process. An outer diameter of the ring 33 is of 0.56"±0.07" and an inner diameter is of 0.38±0.05", and a highest point thereof relative to the ground is at 0.12"±0.06". Accordingly, the combination of the base 32 and ring 33 defines a crater-like shape in the illustrated embodiments of FIGS. 3 and 4, although other shapes are contemplated as well, as described above. In the crater-like shape, the outer surface of the ring 33 is a frusto-conical continuation of the outer surface of the base 31. The ring 33 projects above the top surface 34 by 0.06"±0.03", and has a thickness of 0.09"±0.02" (i.e., difference between outer ray and inner ray). It is pointed out that the top surface 34 may be flat (as shown in FIG. 4), or may have other shapes, such as a dome. Similarly, a top surface of the ring 33 may be flat as shown in FIG. 4, or may have other shapes. For instance, the ring 33 may have a half torus shape.

When an egg is dropped in the cavity 12, it will contact the ring 33, and possibly a part of the top surface 34. The ring 33 is sized so as to temporarily deform (e.g., elastic deformation) or maintain its shape upon contact and hence decelerate the fall of the egg at a suitable rate. The ring 33 may then regain its initial shape, causing some bounce of the egg. However, the geometry of the ring 33 reduces the bounce over some existing bottom configurations, by having a greater stiffness than a dome.

In FIGS. 3 and 4, the base 32 has a height of 0.06"±0.03" from the ground. As a result, when they are in the containers 10 and 10', the eggs are spaced from the ground. Therefore, exterior impacts up to a given magnitude on the receiving cavities 12 will be absorbed by the combination of the downwardly tapering wall of the cavity 12, the bottom surface 31 and the base 32, which concurrently form a second hollow ring 35. It is observed that the cavity 12 defines a pair of concentric frusto-conical portions, with an upright frusto-conical portion formed by the base 32 and/or the ring 33, and an inverted frusto-conical portion formed by the ring 35.

Referring to FIG. 4, a separator wall 40 is shown between adjacent egg receiving cavities 12, in either one of the containers 10 and 10'. The separator wall 40 is shown having an arcuate shape, with a ray of 0.33"±0.04". The separator wall 40 projects upwardly from the horizontal and linear shoulder 41 separating the adjacent receiving cavities, by a height of 0.28"±0.04". In an embodiment, the linear shoulder 41 defines most of the upper contact plane of the base portion 11. The arcuate shape for the separator wall 40 minimizes the amount of material that is used in this region, and hence has limited impact on the structural integrity of the linear shoulder 41. As they are thermoformed, the separator wall 40 and the shoulder 41 are typically hollow. The separator wall 40 is well suited for a receiving cavity 12 having a depth of 1.00"±0.12". This depth value is relatively lower than some existing receiving cavities 12, which may expose some eggs to contacting adjacent eggs during the packaging process. Hence, in an embodiment, the combination of the shock absorber 30 and the separator wall 40 helps in reducing the risk of bouncing egg contact during packaging, for instance in base portions 11 having a reduced height of cavity 12.

The egg containers of the present disclosure may contain any suitable number of egg receiving cavities. One suitable material for the egg containers of the present application is polyethylene terephthalate (PET). PET has many advantages, as this material can be transparent or opaque and can be produced at high volume and at low cost. Wall thicknesses of PET cases in a contemplated embodiment are of 0.0175 inch in thickness, but other thicknesses as low as 0.012 to as high as 0.022 inch are also contemplated. It is pointed out that the thickness may be outside of these ranges, especially after the container 10 is formed. However, any suitable thickness can be used, depending on the fragility of the objects packaged in the container 10.

The invention claimed is:

1. A container for receiving frangible items comprising: a sheet of polymer formed into:

a base portion having a plurality of item receiving cavities for supporting frangible items;

at least one cover portion having at least one item covering concavity for covering the frangible items;

a first hinge between a first longitudinal edge of the base portion and the cover portion for rotating the cover portion onto the base portion to hold the frangible items captive in the item receiving cavities; and a shock absorber formed in at least one of the item receiving cavities, the shock absorber comprising a base projecting upwardly from a bottom wall of the at least one of the item receiving cavities to define an annular contact surface for an item received in the item receiving cavity and a hollow ring extending downwardly from a top of the base to a top wall, an entire area of the top wall disposed a height above and spaced from the bottom wall of the at least one of the item receiving cavities, the shock absorber configured to temporarily deform and deflect downward upon contact with the item and return to an initial shape.

2. The container according to claim 1, wherein the base has a frusto-conical shape.

3. The container according to claim 2, wherein the frusto-conical shape of the base has a cone height ranging between 0.63" and 0.81" and a base diameter ranging between 0.59" and 0.75".

4. The container according to claim 2, wherein an outer surface of the hollow ring forms a frusto-conical continuation of the frusto-conical shape of the base.

5. The container according to claim 1, wherein the base defines a second hollow ring by which the container can contact an underlying surface.

6. The container according to claim 5, wherein the hollow ring and the second hollow ring are concentric.

7. The container according to claim 5, wherein the hollow ring has a frusto-conical outer shape, and the second hollow ring has an inverted frusto-conical outer shape.

8. The container according to claim 1, wherein the at least one cover portion includes an intermediate cover portion and a top cover portion, the intermediate cover portion having item covering cavities for covering the frangible items in the item receiving cavities, and wherein the container further comprises a second hinge between the second longitudinal edge of the base portion, and the intermediate cover portion for rotating the intermediate cover portion onto the base portion, with the top cover portion being hinged about the first longitudinal edge to hold the base portion, the intermediate cover portion and the top cover portion closed together.

9. The container according to claim 1, wherein the hollow ring has a height ranging between 0.03" and 0.09" above a surface in a center of the hollow ring.

10. The container according to claim 1, wherein the frangible items are eggs, and each of the egg receiving cavities receives one egg.

11. The container according to claim 1, further comprising at least one hollow separator wall projecting upwardly from a horizontal shoulder separating adjacent ones of the item receiving cavities.

12. The container according to claim 11, wherein the at least one hollow separator wall has an arcuate shape.

13. The container according to claim 11, wherein the at least one hollow separator wall has a height ranging between 0.24" and 0.32", for a depth ranging between 0.88" and 1.12" from the horizontal shoulder to a bottom of the item receiving cavities.

14. The container according to claim 1, wherein the hollow ring has a crater-like shape.

15. A container for receiving frangible items comprising: a sheet of polymer formed into:

a base portion having a plurality of item receiving cavities for supporting frangible items, with at least a pair of adjacent cavities of the item receiving cavities being separated by a linearly-horizontal shoulder defining an upper horizontal planar surface of at least a portion of the base portion;

at least one cover portion having at least one item covering concavity for covering the frangible items;

a first hinge between a first longitudinal edge of the base portion and the cover portion for rotating the cover portion onto the base portion to hold the frangible items captive in the item receiving cavities;

a shock absorber formed in at least one of the item receiving cavities, the shock absorber comprising a base projecting upwardly from a bottom wall of the at least one of the item receiving cavities to define an annular contact surface for an item received in the item receiving cavity and a hollow ring extending downwardly from a top of the base to a top wall, an entire area of the top wall disposed a height above and spaced from the bottom wall of the at least one of the item receiving cavities, the shock absorber configured to temporarily deform and deflect downward upon contact with the item and return to an initial shape, and at least one hollow separator wall projecting upwardly from the upper horizontal planar surface of the linearly-horizontal shoulder separating the adjacent cavities.

16. The container according to claim 15, wherein the at least one hollow separator wall has an arcuate shape.

17. The container according to claim 16, wherein the at least one hollow separator wall with the arcuate shape has a ray ranging between 0.29" and 0.37".

18. The container according to claim 15, wherein the at least one hollow separator wall has a height ranging between 0.24" and 0.32", for a depth ranging between 0.88" and 1.12" from the horizontal shoulder to a bottom of the item receiving cavities.

19. The container according to claim 15, comprising one said hollow separator wall between each adjacent pair of the item receiving cavities.

20. The container according to claim 5, wherein the hollow ring and the second hollow ring are concentric, the hollow ring has a frusto-conical outer shape, and the second hollow ring has an inverted frusto-conical outer shape.

* * * * *